United States Patent [19]

Spatz

[11] 4,376,495

[45] Mar. 15, 1983

[54] DEVICE FOR ADJUSTING DOSE DISPENSED

[76] Inventor: Walter B. Spatz, 1141 Donaire Way, Pacific Palisades, Calif. 90272

[21] Appl. No.: 268,844

[22] Filed: Jun. 1, 1981

[51] Int. Cl.[3] ..... B65D 35/30

[52] U.S. Cl. ..... 222/46; 222/92; 222/207; 222/309

[58] Field of Search ..... 222/23, 41, 44, 46, 222/71, 92, 106, 386, 389, 251, 252, 253, 207, 212, 213, 305, 309, 424.5, 425, 434, 438, 439, 440, 495, 501

[56] References Cited

U.S. PATENT DOCUMENTS

| | | | |
|---|---|---|---|
| 2,904,227 | 9/1959 | Graham | 222/207 |
| 3,125,250 | 3/1964 | Ballin | 222/96 |
| 3,734,350 | 5/1973 | Waterman | 222/92 |

*Primary Examiner*—David A. Scherbel
*Assistant Examiner*—Kevin P. Shaver
*Attorney, Agent, or Firm*—Bernard Kriegel

[57] ABSTRACT

A metering or dosing device connected to the neck of a squeeze-type tube or container, and capable of metering the amount of fluent material that can be discharged from the container after each removal of a closure cap screw-threaded, or otherwise secured, onto the neck of the container. The dose to be dispensed by the device is determined by the extent to which the cap is mounted on the container.

14 Claims, 3 Drawing Figures

DEVICE FOR ADJUSTING DOSE DISPENSED

The present invention relates to fluid dispensing devices, and more particularly to devices used with a collapsible tube or squeeze bottle for dispensing metered amounts of fluid from the tube or squeeze bottle.

Squeeze-type containers are known which embody metering devices through which fluent material in the container is dispensed. Examples of such containers and metering devices are shown and described in U.S. Pat. Nos. 3,125,250; 3,734,350; 3,587,937; and 2,904,227. The device disclosed in the present application has a low cost of manufacture, lending itself to production with automatic equipment. Additionally, it is easy to assemble, which can also be performed through use of automatic equipment.

The apparatus can receive fluent material disposed in a suitable container, such as a plastic squeeze tube, having a forward portion embodying a metering device containing a control valve, which is shifted to an open position when a cap, or the like, is moved with respect to the container to close the container outlet. The cap also effects shifting of a fluid operated deivce, such as a piston, to a rearward position, the fluent material flowing through the open valve into the forward discharge or dispensing portion of the container, the outlet of which has been closed by the cap. Normally, rearward movement of the piston to a desired extent results in the forward portion of the container being filled with a predetermined or preselected quantity of fluent material. However, as assurance that the forward portion has been fully filled, pressure can be applied to the fluent material in the container. Removal of the cap from the container permits the valve to close and exposes the discharge outlet or orifice at the forward portion of the container, whereupon the pressurizing of the fluent material in the container causes such material to act upon the piston and shift it in a forward direction, discharging the fluent material through the orifice until travel of the piston ceases because of its coming to rest against a suitable stop. The volume of material to be dispensed can be preselected by controlling the distance that the cap can move the piston in a rearward direction. The greater the extent of rearward movement, the greater is the amount of material that will be dispensed upon removal of the cap and the application of pressure of the fluent material in the container, which shifts the piston and the cosed valve in a forward direction until the piston engages the stop.

This invention possesses many other advantages and has other purposes which may be made more clearly apparent from a consideration of a form embodying the invention. This form is shown and described in the present specification and in the drawings accompanying and constituting a part thereof. It will now be described in detail, for the purpose of illustrating the general principles of the invention; but it is to be understood that such detailed description is not to be taken in a limiting sense.

Referring to the drawings

Figure 1:
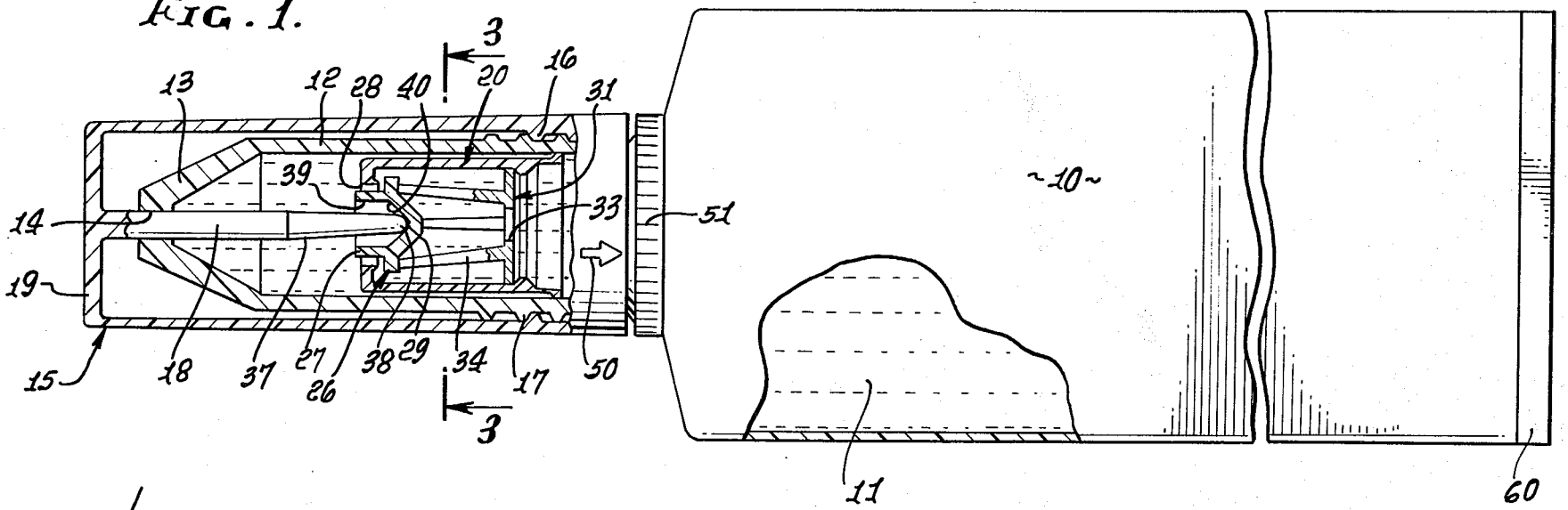
FIG. 1 is a longitudinal section through a container and metering device, portions being shown in elevation.
Figure 2:
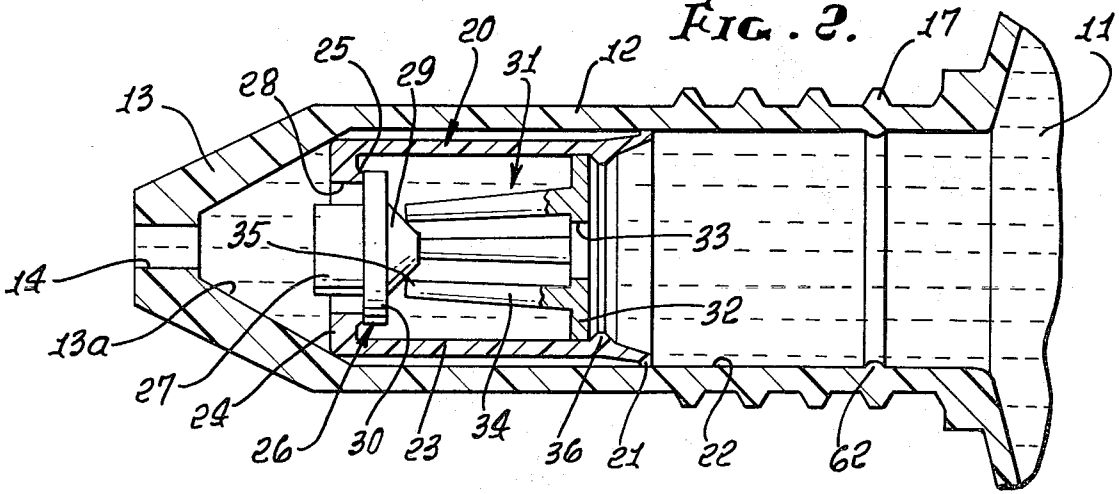
FIG. 2 is an enlarged longitudinal section through the forward portion of the container and metering device shown in FIG. 1, with the cap removed.
Figure 3:
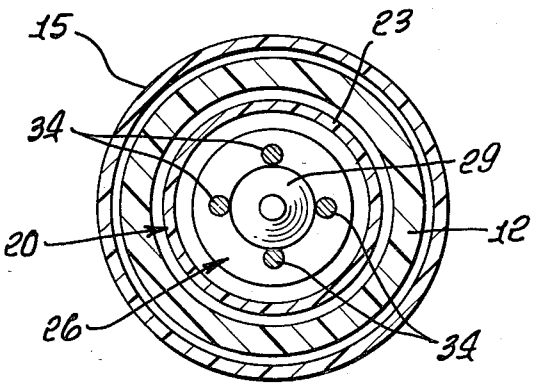
FIG. 3 is an enlarged cross-section taken along the line 3—3 of FIG. 1.

A container 10, such as a plastic squeeze tube, contains a fluent material 11 to be dispensed. It includes an elongated neck 12 terminating at its forward end in a nozzle or nose 13 having an opening or orifice 14 through which the fluent material is discharged, in response to the application of pressure to the fluent material in the deformable container 10. The discharge opening 14 can be closed by a cap structure 15 having an internal helical thread 16 at its rearward portion adapted to mesh with a companion external thread 17 formed on the rearward portion of the neck. To close the opening 14, the cap is slipped over the neck and a central pin or rod 18 projecting inwardly from the end wall 19 of the cap moves into the opening or orifice to close the latter. The pin has a cylindrical portion, making a close sliding fit with the companion cylindrical wall of the orifice 14 to provide a seal and prevent leakage of fluid from the neck through the orifice. Turning of the cap 15, as to the right, will engage the internal and external threads 16, 17 and cause the cap to feed longitudinally along the neck 12 and the central pin 18 within the neck to the extent selected by the user of the apparatus. Preferably the threads are multiple start threads, such as double start threads, to increase the extent of longitudinal movement of the cap in proportion to the extent of its turning.

Disposed within the neck is a hollow piston structure 20 having a rear circumferential lip 21 adapted to slidably engage the inner wall 22 of the neck. This piston structure has a skirt portion 23 integral with an inwardly directed flange 24 having a circumferential rib 25 providing a valve seat adpated to be engaed by a check valve 26. This check valve is generally cup-shaped, including a skirt 27 extending into an opening 28 defined by the piston flange, the skirt merging into a rearwardly tapering conical head 29, a valve flange 30 being adapted to move into sealing engagement with the valve seat 25 in order to close the valve opening.

The valve 26 is normally urged into engagement with its seat by a spring device 31 located within the piston 20, which includes a spring base 32 having a central opening 33. The base is integral with a plurality of longitudinally extending flexible arms 34 which inherently tend to move transversely toward the axis of the valve head, the forward ends 35 of the arms shifting inwardly toward the valve axis and in so doing engaging the conical surface of the valve head 29 to shift the valve forwardly and place its flange 30 into sealing engagement with the valve seat 25 to close the opening 28. Rearward movement of the spring base 32 within the piston is prevented by engagement of the base with an inwardly directed, circumferential stop rib 36 provided on the piston 20.

The central pin 18 includes a rearwardly tapering portion 37 terminating in a rounded nose 38 and movable into a centering cavity 39 provided by the rearwardly tapering inner wall 40 of the conical head, which tends to center the valve 26 with respect to the central pin 18, 37.

As the cap 15 is shifted rearwardly over the neck 12, the central pin 18 will slide through the discharge opening 14 in the nozzle 13 until the nose portion of the pin moves into the cavity 39 and engages the valve 26, which is then in a position engaging the valve seat 25 and closing the piston opening 28, with the forward portions of the spring arms 34 being in their contracted position engaging the external conical surface 29 of the head. Continued rearward movement of the central pin 18 causes it to shift the valve 26 rearwardly and off its valve seat 25, to open the valve passage 28 to the extent limited by the engagement of the free ends 35 of the spring arms with the valve flange 30, such as disclosed in FIG. 1. Continued rearward movement of the central pin 18 and cap 15 then moves the valve head 28, spring 31 and piston 20 as a unit rearwardly within the neck of the container to a desired position, depending upon the extent to which the cap has been threaded on the container nose 12. A suitable marking 50 is placed on the external rearward surface of the cap and companion marking 51 on the adjacent cylindrical surface of the container 10 to indicate the extent to which the cap has been threaded on the nose. As an example, an arrow 50 may be provided on the periphery of the rear portion of the nose, and suitable graduation marks 51 placed on the cylindrical surface of the container which cooperate with the arrow and enable the user to read the position to whch the cap 10 and the pistom 20 and valve device 26, 31 have been shifted within the container.

In FIG. 1, the cap 15 has been threaded on the neck 12 to a desired extent, causing the central pin 18 to shift the valve 26 to the open position and the piston 20 to the desired axial position within the nose, as indicated by the graduation mark 51 to which the metering arrow 50 has been positioned. During rearward movement of the piston 20, spring 31 and valve 26, the fluent material is forced through the base opening 33 into the interior of the piston, flowing around the valve head 29 and out through the valve opening 28 into the forward portion of the neck 12 and the nozzle or nose 13, until all of the space within the piston and forwardly of the piston within the neck is filled. If desired, the fluent material can have pressure applied to it, as by squeezing the tube 10, to insure complete filling of the forward portion of the neck.

When the material is to be dispensed through the orifice 14, the cap is unthreaded from the neck, and the central pin 18 withdrawn through the orifice 14, opening the latter. Upon withdrawal of the pin, the spring arms 34 will inherently shift inwardly of the axis of the piston, sliding down along the tapered portion of the conical head 29 and shifting the latter in a forward direction until the valve flange 30 engages the valve seat 25. With the centering pin 18 withdrawn, the fluent material in the container is again pressurized, as by squeezing the tube, which will cause the piston and valve to move forwardly as a unit within the neck 12 to dispense the fluent material in the forward portion of the neck through the discharge opening 14. The piston 20 and valve 26 will continue to move as a unit until the piston engages the tapered walls 13*a* of the nose 13, whereupon further dispensing of fluent material through the orifice 14 ceases. The volume of material dispensed through the orifice corresponds to the distance the piston 20 has traveled until it engages the tapered stop wall 13*a* of the nose.

After the full dispensing of metered quantity of fluent material has occured, the cap is remounted on the nose with its central pin disposed within the nose and the cap threaded onto the nose. The central pin 18 again engages the valve member 26, shifting it to the open position and then moving the piston 20 and valve 26 device as a unit rearwardly of the nose to a position corresponding to the alignment of the metering arrow 50 with the selected graduation mark 51 on the container, the forward neck portion in advance of the piston 20 and valve-spring structure 26, 31 having been completely filled. The apparatus is ready for another dispensing operation, which can occur upon removal of the cap 15 and reapplication of pressure to the fluent material by any suitable means, as, for example, the squeezing of the deformable tube.

The plastic squeeze tube or container 10 may be of any suitable type, the one specifically disclosed having its rear end 60 closed by crimping, after the tube has been filled with the fluent material.

The device disclosed has a low cost of manufacture and is easy to assemble, the parts being made on automatic equipment and the assembly also being performed by automatic equipment. The piston 20, valve 26, and spring device 31 are easily assembled, the spring base 32 being mounted within the piston by forcing it through the stop rib 36, which is made of flexible material, and which will deflect out of the way until the spring device is appropriately disposed within the piston between the rib 36 and the valve member 26. The piston, spring and valve combination are readily mounted through the rear of the container or tube, prior to filling the tube with fluent material. The piston, spring and valve combination are readily shifted into the neck 12 with the piston moving past a stop rib 62 in the neck, since the lip seal 21 can deflect inwardly and slide through the stop rib 62, the stop rib 62 limiting the extent of rearward movement of the piston, spring and valve within the container neck.

After the piston, spring and valve combination has been inserted in the neck 12, the fluent material is disposed in the container and its rear end closed by crimping at 60. The fluent material cannot escape from the container and its neck since the valve is in a closed position. It can only be shifted forwardly in the container, until arrested by engagement of the forward portion of the piston with the tapered stop wall 13*a*.

I claim:

1. A dispensing apparatus for fluent material comprising a container member having a discharge opening, piston means shiftable axially in said member in sealing engagement therewith, said piston means having a passage through which the fluent material in said member can flow forwardly towards said opening, valve means for closing said passage, operating means movable through said opening for shifting said valve means from closed to open position and said piston means rearwardly in said container member to a preselected position, and means for closing said valve means upon withdrawal of said operating means from said opening, whereby the fluent material can be pressurized to shift said piston means towards said opening and fluent material forwardly of said piston means through said opening.

2. Apparatus as defined in claim 1, and stop means for limiting forward movement of said piston means in said container member.

3. Apparatus as defined in claim 2, and stop means for limiting rearward movement of said piston means in said container member.

4. Apparatus as defined in claim 1, said means for closing said valve includes a spring means for shifting said valve means to a closed position.

5. Apparatus as defined in claim 1, said operating means including a cap mounted on said container member to enclose said opening.

6. Apparatus as defined in claim 5, and means on said cap and container member for indicating the extent of rearward movement of said piston means in said container member.

7. Apparatus as defined in claim 6, and means threadedly connecting said cap to said container member.

8. Apparatus as defined in claim 5, and means threadedly connecting said cap to said container member.

9. Apparatus as defined in claim 1, and means for indicating the extent of rearward movement of said piston means in said container member.

10. A dispensing apparatus for fluent material comprising a container having a neck provided with a discharge opening, piston means shiftable axially in said neck in sealing engagement therewith, said piston means having a passage through which the fluent material in said neck can flow relatively forwardly through said passage towards said opening, valve means for closing said passage, a cap mounted on said neck and movable axially thereof, said cap having a pin extending through said opening into said neck and being engageable with said valve means to shift said valve means from closed position to open position and said piston means rearwardly in said neck, and means for closing said valve means upon withdrawal of said pin from engagement with said valve means, whereby the fluent material can be pressurized to shift said piston means towards said opening and fluent material forwardly of said piston means through said opening.

11. Apparatus as defined in claim 10, said container being squeezable, enabling it to be squeezed to apply pressure to the fluent material in said container and its neck.

12. Apparatus as defined in claim 10, and means for indicating the extent of rearward movement of said piston means in said neck.

13. Apparatus as defined in claim 10, and means on said cap and container for indicating the extent of rearward movement of said piston means in said neck.

14. Apparatus as defined in claim 10, and means threadedly connecting said cap to said neck.

* * * * *